US008128583B2

(12) United States Patent
Ghatge

(10) Patent No.: US 8,128,583 B2
(45) Date of Patent: Mar. 6, 2012

(54) STIMULATOR PAD

(76) Inventor: Ramesh Ghatge, Sutton Coldfield (GB)

( * ) Notice: Subject to any disclaimer, the term of this patent is extended or adjusted under 35 U.S.C. 154(b) by 882 days.

(21) Appl. No.: 12/179,595

(22) Filed: Jul. 25, 2008

(65) Prior Publication Data

US 2009/0030354 A1 Jan. 29, 2009

(30) Foreign Application Priority Data

Jul. 25, 2007 (GB) ..... 0714485.0
Aug. 7, 2007 (GB) ..... 0715346.3

(51) Int. Cl.
*A61H 7/00* (2006.01)

(52) U.S. Cl. ..... 601/134; 601/136

(58) Field of Classification Search ..... 601/134, 601/22, 23, 27, 28, 29, 30, 31, 84, 104, 136; 482/79, 91, 148; 36/35 R, 38, 141
See application file for complete search history.

(56) References Cited

U.S. PATENT DOCUMENTS

| | | | | |
|---|---|---|---|---|
| 6,475,171 | B1 * | 11/2002 | Williams | 601/98 |
| 2004/0250449 | A1 * | 12/2004 | Testa et al. | 36/35 R |
| 2008/0010868 | A1 * | 1/2008 | Tsai | 36/141 |
| 2008/0184594 | A1 * | 8/2008 | Ebeling | 36/11.5 |

FOREIGN PATENT DOCUMENTS

| | | | |
|---|---|---|---|
| DE | 26 19 410 | A | 11/1976 |
| DE | 298 07 618 | U1 | 7/1998 |
| DE | 20 2004 020 078 | U1 | 3/2005 |
| DE | 202004020078 | * | 4/2005 |
| FR | 2 483 225 | A | 12/1981 |
| JP | 10-15026 | A | 1/1998 |
| JP | 2000-93487 | A | 4/2000 |
| RU | 2 113 205 | C1 | 6/1998 |
| WO | WO00/78265 | * | 12/2000 |

* cited by examiner

*Primary Examiner* — Patricia Bianco
*Assistant Examiner* — Raymond E Harris
(74) *Attorney, Agent, or Firm* — Young & Thompson

(57) ABSTRACT

A stimulator pad includes a layer of support material and at least one stimulator node secured to and supported by the support layer, the stimulator node comprising a housing having one end region secured relative to the support layer and the other end defining an aperture which in use confronts a body surface and in which at least one pressure member includes a plurality of pressure member components is resiliently located, resilient biasing device provided within the housing to act between the support layer or a base portion of the housing and at least some of the pressure member components to urge the at least some of the pressure member components to protrude through the housing aperture, and a layer of flexible cover material which extends over at least one of the pressure members.

15 Claims, 4 Drawing Sheets

G REFLEX SOL

STIMULATOR PAD

This invention relates to a stimulator pad and in particular, though not exclusively, to a personal stimulator pad for use with the human body to provide stimulation to regions such as the palm of a hand or the sole of a foot.

It is well understood that regions of the sole of a foot or the palm of a hand are specifically associated with different organs of the body, such as the liver, kidneys and brain, and that stimulation of the respective areas of the sole or palm can have a beneficial effect on the overall well-being of an individual.

It is also well understood that providing localized stimulation to selected parts of the body, such as the heel region of a sole, can actively promote improved circulation of blood, with particular potential benefit in reducing the risk of deep vein thrombosis (DVT) and of promoting general well-being.

The present invention seeks to provide a stimulator pad which is convenient to use and effective to provide stimulation to at least one, and more preferably to a plurality, of different parts of the body.

In accordance with one aspect of the present invention I provide a stimulator pad comprising a layer of support material and a plurality of stimulator nodes secured to and supported by the support layer, said stimulator nodes each comprising a housing having one end region secured relative to the support layer and the other end defining an aperture which in use confronts a user's body surface and in which there is resiliently located at least one pressure member comprising a plurality of pressure member components for contact with the user, resilient biasing means provided within the housing to act between the support layer or a base portion of the housing and at least some of said pressure member components to urge said at least some of the pressure member components to protrude through the housing aperture, and a layer of flexible cover material which extends over said at least one pressure member at a stimulator node.

The support layer may be a layer of flexible material that may itself be substantially resilient in a manner similar to that of a conventional insole for footwear.

Alternatively a support layer may be a layer of material which is substantially rigid and or incompressible.

The biasing means may be in the form of a mechanical spring such as a helical spring. However other types of biasing means are contemplated by the present invention, such as, for example, a gas filled flexible capsule or an element of a resilient material such as foam rubber.

One end of the biasing means optionally may be secured to the support layer or, in the case of a housing having a base which extends inwards, may be secured to that base.

The other end of the biasing means may have the pressure member secured thereto such that the pressure member is restrained from becoming displaced from the stimulator pad. Alternatively or additionally the pressure member may be dimensioned in relation to the housing aperture such that although it may protrude through the aperture it is not able to pass wholly through that aperture.

The housing may be formed from a rigid material or a semi-rigid or flexible material. Preferably, as considered in the direction in which the housing extends from the support layer, the housing is more resistant to compression than the assembly of the pressure member and resilient biasing means. The housing may be of a construction which allows the distal, apertured end to deflect laterally relative to the base region, i.e. in a direction perpendicular to the direction in which the housing extends from the support layer.

One suitable shape for a pressure member component is that of a sphere, and for that purpose the pressure member component may for example comprise a ball bearing. A pressure member component may also be of a part-spherical shape. As an alternative to a metallic material the pressure member may be formed from a material such as plastics or glass.

All or at least some of the pressure member components provided within or supported by a housing may be acted on by the resilient biasing means.

The pressure member may comprise a plurality of substantially similar shaped components, such as a cluster of ball bearings, and each pressure member component may be secured relative to the resilient biasing means to control and restrain movement away from the housing. Some or each of a plurality of pressure member components associated with a common housing may be moveable against the biasing means independently of one or more other pressure member components of said plurality.

One suitable shape for the housing is a frusto-conical shape, with the narrow end defining the aperture for the pressure member. However other shapes may be employed such as two frusto-conical shaped sections arranged in series with the narrow ends adjoining. In that case the section furthest from the support layer may be utilized to locate a plurality of pressure member components.

In the case of a support layer which is to be used as an insole for footwear the support layer may support a plurality of housings at each of the positions which, in use, will confront one of those zones of the sole of a foot which are recognized by reflexology experts to be associated with a specific organ of the body.

Additionally the stimulator pad may provide support for a resilient member adapted to act, in use of footwear incorporating the insole, as an exercise device to promote circulation and reduce the risk of a deep vein thrombosis condition arising. A particularly suitable device for associating with an insole and to promote circulation is an exercise device as described and claimed in my granted UK patent GB 2392853B.

Thus a stimulator pad for use as a footwear insole may incorporate a resilient exercise device positionable in use to lie underneath a person's heel, and said resilient exercise device having a spring rate between 1 N/mm and 5 N/mm and comprising a resilient hollow body of a resilient material, and said body having a height of between 10 mm and 35 mm when in an uncompressed condition.

Preferably the resilient exercise device has a height between 15 mm and 25 mm when in an uncompressed condition, more preferably between 18 mm and 25 mm.

The construction of the resilient exercise device preferably is such as to result in a degree of resiliency having a spring rate in the range 2 N/mm, to 3 N/mm. Resiliency may be provided substantially only by said resilient material of the hollow body.

The resiliency property of the resilient exercise device may be provided by a resilient body of compressible and resilient material such as, for example, rubber or a plastics material such as a thermoplastic elastomer (e.g. ex Dupont). Use of a recyclable resilient material is particularly preferred. The resiliency property may be provided substantially solely by said resilient body. The resilient body may, for example, be a solid body or may be hollow and may comprise an outer surface which in part is curved and in part is flat for resting on a support surface.

The resiliency property of the resilient exercise device additionally or alternatively may be provided by mechanical spring means such as a helical compression spring. The mechanical spring means may be formed from a metal or a plastics material. The mechanical spring means may be located within and covered by a flexible envelope. The device may comprise a resilient body which serves also as said flexible envelope. The flexible envelope optionally may be of a compressible and resilient material such as that described above, the envelope material and mechanical spring means then each contributing to the resultant resiliency property of the resilient exercise device.

A resilient body of a hollow construction, or a flexible envelope as described in the preceding paragraph, may define a sealed enclosure whereby resiliency arises at least in part by the compressibility of a gas, typically air, contained within the enclosure. Alternatively the hollow body or envelope may be vented to atmosphere. The resilient body may incorporate whistle means which emits a sound during compression or relaxation of the device.

The resilient exercise device may be secured to or formed integrally with a substantially planar and substantially inflexible base which forms a part of the footwear insole.

The maximum dimension of the resilient body of the exercise device in a direction perpendicular to the intended direction of compression in normal use preferably is less than 40 mm, more preferably less than 30 mm. Said dimension preferably is greater than 10 mm and preferably greater than 20 mm.

The resilient body may be of a circular external profile as considered in a cross-sectional plane perpendicular to said intended direction of compression.

In the case of a mechanical spring means contained within a resilient body of compressible and resilient material, said resilient body of compressible material preferably is of non-spherical shape and may, for example, be of either a part spherical shape or a dome shape. Other potentially suitable shapes are cylindrical and barrel shapes, and also an egg timer type shape comprising in effect two part spherical or dome shapes arranged adjacent to one another and with internal chambers defined by the two parts being in communication with one another. A single mechanical spring means may extend through each of the two chambers.

The present invention further provides a footwear item having an insole which comprises a stimulator pad in accordance with the present invention and in addition a hollow heel region adapted to locate a resilient exercise device in either a first position in which a resilient part of the resilient exercise device lies in a cavity defined by said heel region or a second position in which said resilient part extends above the heel region thereby, in use, to be compressible by a person's heel.

The resilient parts of the exercise device may be dimensioned in relation to the cavity such that when the resilient exercise device is in said first position said resilient part within the cavity may be in an uncompressed state or, in an alternative embodiment, in a state of compression which is substantially constant and independent of movement of a person's heel.

The cavity may extend through the whole or only a part of the thickness of a heel.

The cavity may extend through only part of the thickness of the heel and be open at an upper surface of the heel portion. The resilient exercise device may comprise a base plate of substantially rigid material and which is locatable in a mouth region of the cavity with said resilient part lying either above or below said base plate. The base plate preferably is located against transverse movement relative to the heel portion. The mouth region may comprise for example a recess which extends around the mouth region of the cavity and in which the outer edge of the base plate may be located.

In a manner similar to that described above in respect of an insole for footwear, the support layer of the stimulator pad may be shaped for use as an insert or lining of a glove or mitten, with the housings of a plurality of pressure nodes selectively positioned such that, in use, they confront those areas of a palm recognized to be associated with different organs of the body.

Although the support layer may be employed as an insole for footwear or the lining of a glove (or mitten), it is to be understood that it may be of a free-standing type for use independently of footwear or a glove. Thus a free-standing stimulator may be contacted directly by the sole of a foot or the palm of a hand without the presence of an item of footwear or a glove. In the use of a free-standing stimulator the sole or palm is moved gently to and fro over the stimulator nodes and the resilient biasing of the pressure members results in active stimulation of the respective zones of the sole or palm. In the case of a stimulator which is an insole for footwear or an insert or lining of a glove, that stimulation may arise either by an individual intentionally moving a foot or hand within the footwear or glove or in consequence of the relative movement which occurs between a foot and footwear or a hand and glove during normal walking and general use of a hand.

The layer of flexible cover material may be a layer which is arranged to extend over a plurality of stimulator nodes and may be secured to the layer of support material and/or to at least one stimulator node housing. Alternatively a single cover piece may extend over only a single node and may be secured to the housing of that node and/or to the surrounding support layer.

Embodiments of the present invention will now be described, by way of example only, with reference to the accompanying diagrammatic drawings in which:—

Figure 1:
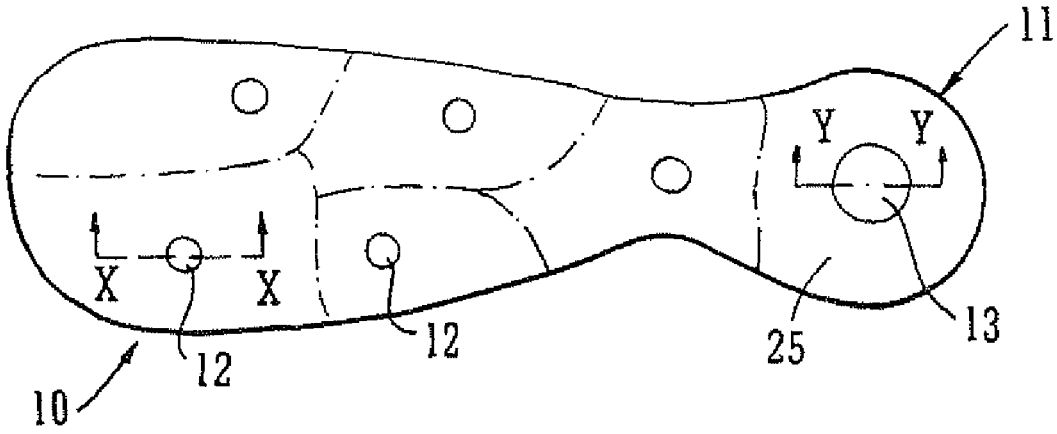
FIG. 1 is a plan view of a G. Reflexsol stimulator pad of a type on which the present invention is based.
Figure 2:
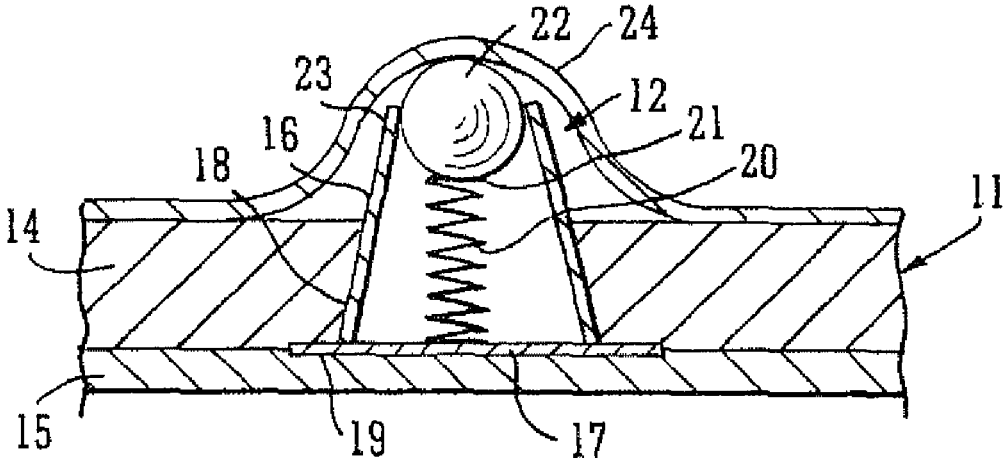
FIG. 2 is a section on the line X-X of FIG. 1.

A stimulator pad 10 for use as an insole comprises a flexible support 11 to which are secured five stimulator nodes 12 and an additional resilient member in the form of an exercise dome 13.

The flexible support 11 comprises two layers 14, 15 of flexible material of the kind conventionally employed for insoles. The two layers are bonded together to form a unitary structure.

Each stimulator node 12 comprises a frusto-conical shaped housing 16 having a closure plate 17 secured thereto at the lower, wider end 18. The closure plate 17 extends radially outwards to form a flange location portion 19.

The upper layer 14 of the flexible support is apertured to allow the housing 16 to extend therethrough, and the flange 19 lies held sandwiched between the layers 14, 15 thereby to serve to retain the stimulator node in position relative to the flexible support 11.

The closure plate 17 additionally provides support for and has secured thereto a helical coil spring 20. The upper end 21 of the coil spring has secured thereto a stainless steel ball 22 of a diameter slightly greater than that of the narrow end 23 of the housing 16.

A layer of thin flexible material 24 extends over the stimulator nodes 12 and is bonded to the upper layer 14.

Referring again to FIG. 1, a stimulator node 12 is provided at each of the five sections of the sole in accordance with the conventional understandings of reflexology, and the heel region 25 is provided with the aforementioned exercise dome 13 which is described in more detail in the following paragraphs. In a variation of this configuration, instead of only one node at each end of the five sections, a plurality of stimulator nodes may be provided at some or each of the aforementioned sections.

Figure 4:
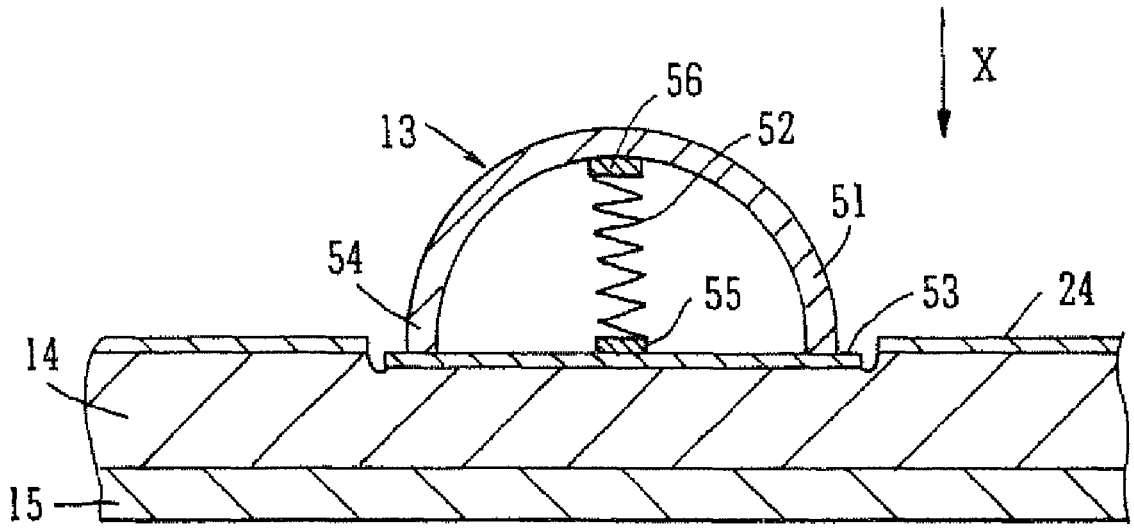
FIG. 4 is a section on the line Y-Y of FIG. 1.

The exercise dome (see FIG. 4) comprises a resilient dome body 51, a helical compression spring 52 and a base 53.

The dome body 51 is formed of resilient thermoplastic elastomer and is of a hollow form having a substantially uniform wall thickness. The open end 54 of the hollow dome body is bonded to the base 53 which is of a flat circular shape and formed from a relatively hard plastics material such as polytretrafluoroethylene (PTFE). The base 53 has a diameter slightly greater than the diameter of the open end 54 of the dome body 51. The base 53 is bonded to a recess in the upper layer 14 of the insole, at the heel region of the insole though alternatively it may not be bonded and may be selectively removed by a user. The cover layer 24 is apertured so that the dome body is exposed for direct contact by a user.

The dome 51 has a height, as considered in a direction perpendicular to the plane of the base 53 which, in this embodiment, is 25 mm. The wall thickness is approximately 6 mm.

The external diameter of the open end of the dome body is 25 mm. Small vent holes (not shown) allow air to flow freely in and out of the chamber defined internally of the dome.

The helical compression spring 52 has a length when in an unstressed condition of 20 mm, and an outside diameter of 10.5 mm. The spring rate is 2.6 N/mm. A small disc 56 of plastics material is bonded centrally to the inner surface of the dome body 51 and a corresponding small disc 55 is bonded centrally to the confronting surface of the base 53. The discs 55,56 are dimensioned to sit within the respective ends of the coil spring 52 thereby to resist any lateral displacement of the coil spring when in use.

In use of the stimulator pad 10 each of the stimulator nodes 12 will bear against a respective region of the individual's sole and the ball 22 of each stimulator node will provide local stimulation. When subject to compression load the ball 22 will tend to retract slightly into the housing and in that condition additionally will be free to move slightly in a lateral direction thereby to further assist in providing beneficial stimulation. The exercise dome 13 will function to promote blood flow in the deep veins of a leg in consequence of being positioned underneath the user's heel. Circulation is promoted by exercising the calf muscle to press downwards, in the direction shown by arrow X of FIG. 4 to compress the spring and resilient dome body 51, and then releasing that compression. The compression and relaxation cycle is repeated continuously, at a suitable speed, and for a suitable period of time selected having regard to the circumstances and the potential needs of the user. The exercise of the heel pushing down on the dome causes the calf muscles to contract, which in turn pushes the blood upwards by squeezing deep veins in the leg, thereby promoting veinous circulation.

In another construction a stimulator node 30 is constructed substantially similar to the stimulator node 12 described above except that the housing 31 comprises two frusto-conical section 32, 33 arranged back-to-back with their narrow end regions 34 integral with one another. The helical compression spring 35 extends within the housing through the narrow regions 34 to support and be integral with a steel ball 36. In this embodiment, under light vertical load the ball 36 is free to move laterally within the width of the upper, open end 37 of the housing, but the freedom for lateral movement reduces as the ball 36 is subject to increasing load and moves downwards towards a narrower part of the housing.

Figure 3:
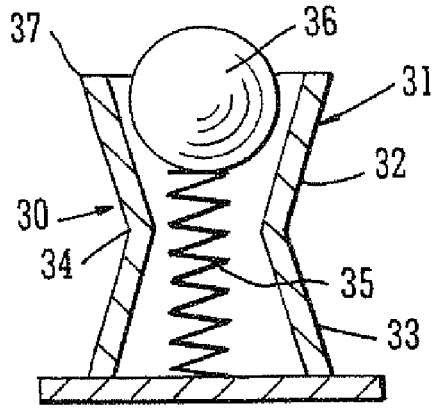
FIG. 3 shows part of the assembly of FIGS. 1 and 2 in more detail.
Figure 5:
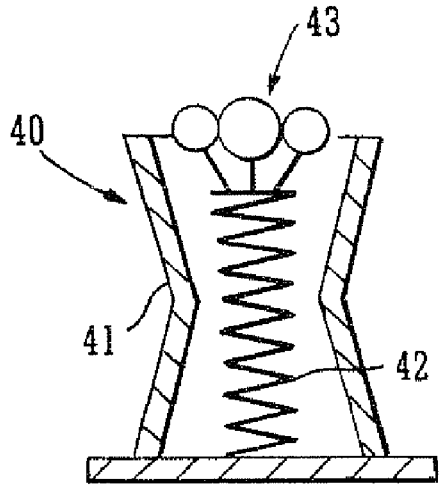
FIG. 5 is a sectional view of a stimulator node in accordance with another embodiment of the present invention.
Figure 6:
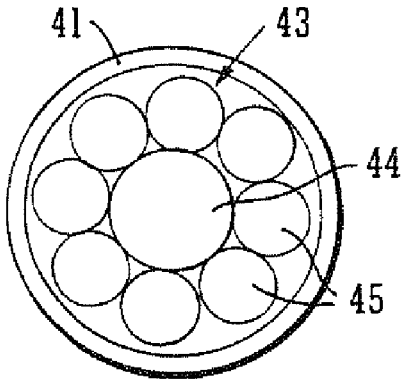
FIG. 6 is a plan view of the stimulator node of FIG. 5.

In accordance with another embodiment of the present invention, shown in FIGS. 5 and 6, a stimulator node 40 comprises a housing 41 and spring 42 substantially similar to the housing and spring described with reference to FIG. 3. However, instead of supporting a single ball the upper, free end of the spring 42 provides support for a cluster 43 of eight stainless steel balls. The cluster comprises a central ball 44 surrounded by seven slightly smaller diameter balls 45. Each of the balls 44,45 are individually secured to the upper, free end of the spring 42. In use the cluster 43 is free to move in manner similar to that described in respect of the ball 36 of FIG. 3, but the use of a cluster of balls provides a plurality of localised points of stimulation in contrast to the single point of stimulation provided by the ball 36 of FIG. 3.

Figure 7:
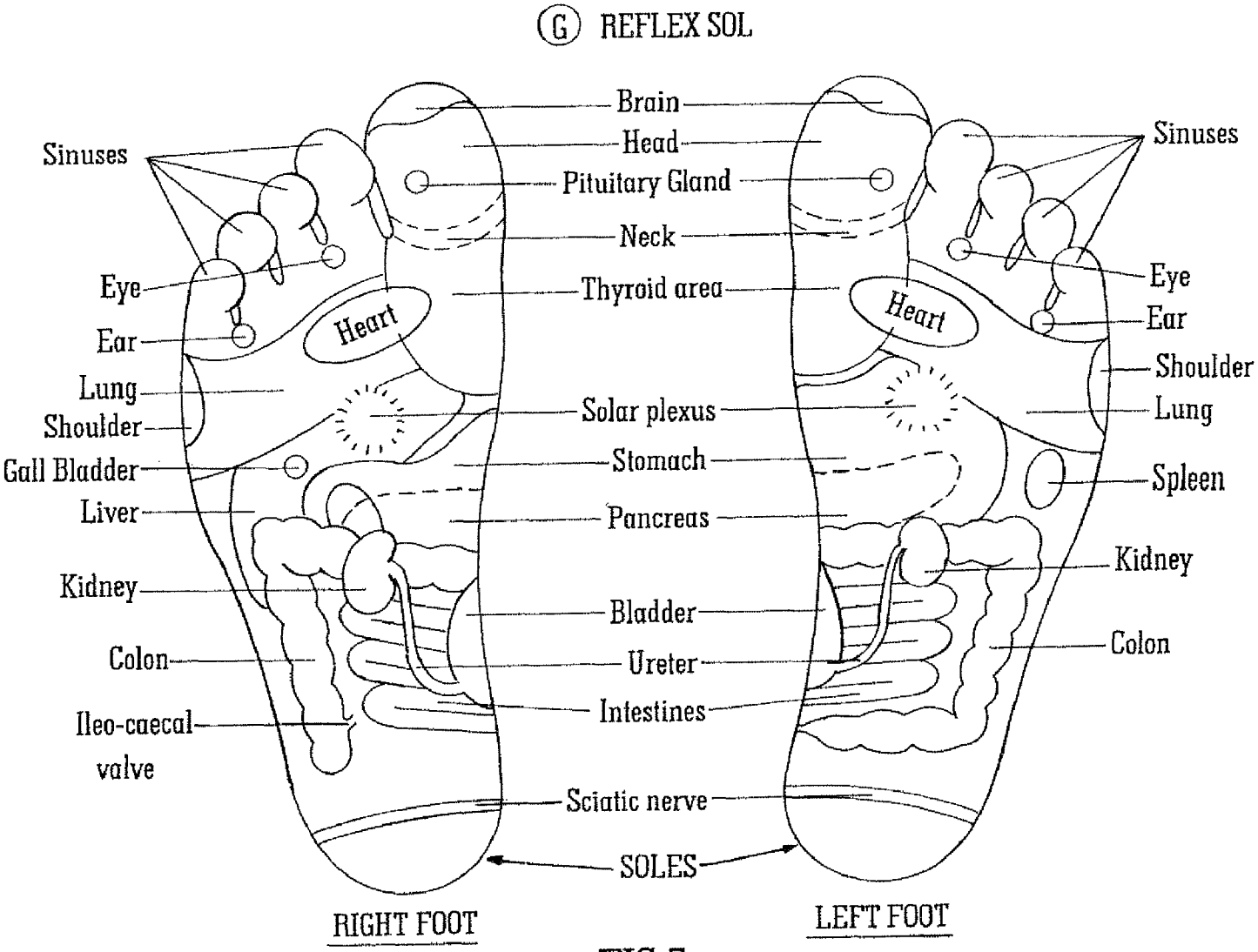
FIG. 7 shows areas of the left and right feet which are associated with respective other parts of the human body.

Although FIG. 1 illustrates a flexible support having stimulator nodes at only five regions, typically nodes may be provided at some or all of more specifically defined positions which are determined in accordance with established principles of reflexology. FIG. 7 shows such positions, some of which are of a more complex shape than indicated by the simplified illustration of FIG. 1.

Whilst it has been described above that the stimulator node shall comprise a spring-loaded ball, it is to be understood that pressure members of other shapes, not necessarily spherical, may be employed to result in a beneficial, therapeutic effect.

The invention claimed is:

1. A stimulator pad in the shape of an insole for footwear and having a sole region and a heel region, said stimulator pad comprising:

a flexible support comprising two layers of flexible material bonded together to form a unitary structure, and a plurality of stimulator nodes secured to and supported by the sole region of the flexible support, said stimulator nodes each comprising a housing having at one end a base region secured relative to the flexible support and the other, distal, end defining an aperture which in use confronts a user's foot and in which there is resiliently located a pressure member comprising a plurality of pressure member components each for acting against the user's foot, the base region of each housing extending outwards in the form of a flange which lies sandwiched between said two layers of flexible support material with the housing of each stimulator node extending through a respective one of a plurality of apertures in an upper of said two layers, resilient biasing means provided within the housing to act between the flexible support or said base region of the housing and at least some of said pressure member components to urge said at least some of the pressure member components to protrude at the distal end of the housing, each said housing being more resistant to compression than the assembly of the pressure member components and resilient biasing means contained within said housing, said distal end of the housing being free to deflect laterally relative to the base region thereof, a resilient exercise device, comprising a hollow body of elastomeric material, secured to said flexible support and positioned at the heel region of the insole and adapted to act to promote circulation in use of footwear incorporating the stimulator pad as an insole, and a layer of flexible cover material secured to the upper layer of support material, said cover material extending over said pressure members at each stimulator node and being apertured at the heel region whereby the resilient exercise device extends through said cover layer for direct contact by a user.

2. The stimulator pad according to claim 1, wherein the flexible support layer is substantially incompressible.

3. The stimulator pad according to claim 1, wherein the flexible support is substantially resilient and flexible material.

4. The stimulator pad according to claim 1, wherein the biasing means comprises a mechanical spring.

5. The stimulator pad according to claim 1, wherein the biasing means comprises an element of a resilient material.

6. The stimulator pad according to claim 1, wherein the biasing means is secured to the flexible support.

7. The stimulator pad according to claim 1, wherein the housing comprises a base which extends inwards and the biasing means is secured to said base.

8. The stimulator pad according to claim 1, wherein an end of the biasing means has a pressure member secured thereto.

9. The stimulator pad according to claim 1, wherein the pressure member protrudes but does not pass wholly through the housing aperture.

10. The stimulator pad according to claim 1, wherein the housing is more resistant to compression than the assembly of the pressure member and the resilient biasing means.

11. The stimulator pad according to claim 1, wherein the distal, apertured end of the housing is free to deflect laterally relative to said base region of the housing.

12. The stimulator pad according to claim 1, and comprising pressure member components of a spherical or part-spherical shape.

13. The stimulator pad according to claim 1, wherein each said pressure member component is secured relative to the resilient biasing means.

14. The stimulator pad according to claim 1, wherein at least some of a plurality of pressure member components associated with a common housing are moveable against the biasing means independently of one or more other pressure member components of said plurality.

15. The stimulator pad according to claim 1, wherein the housing is substantially of a frusto conical shape.

* * * * *